US009711274B2

(12) United States Patent
Oyama et al.

(10) Patent No.: US 9,711,274 B2
(45) Date of Patent: Jul. 18, 2017

(54) STATIONARY INDUCTION APPARATUS

(71) Applicant: Hitachi, Ltd., Chiyoda-ku, Tokyo (JP)

(72) Inventors: Taku Oyama, Tokyo (JP); Takahide Matsuo, Tokyo (JP); Kenichi Kawamura, Tokyo (JP); Akira Yamagishi, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/743,680

(22) Filed: Jun. 18, 2015

(65) Prior Publication Data

US 2015/0371767 A1 Dec. 24, 2015

(30) Foreign Application Priority Data

Jun. 20, 2014 (JP) ..... 2014-126949

(51) Int. Cl.

| | |
|---|---|
| ***H01F 27/00*** | (2006.01) |
| ***H01F 27/24*** | (2006.01) |
| ***H01F 27/26*** | (2006.01) |
| ***H01F 27/33*** | (2006.01) |
| ***H01F 27/245*** | (2006.01) |
| ***H01F 27/32*** | (2006.01) |

(52) U.S. Cl.

CPC ..... *H01F 27/33* (2013.01); *H01F 27/245* (2013.01); *H01F 27/263* (2013.01); *H01F 27/324* (2013.01)

(58) Field of Classification Search

CPC ..... H01F 27/33; H01F 27/263; H01F 27/28; H01F 27/245; H01F 27/324; H01F 27/32; H01F 27/26

USPC ..... 336/100, 216, 217, 210

See application file for complete search history.

(56) References Cited

U.S. PATENT DOCUMENTS 1,782,521 A * 11/1930 Trombetta ..... H01F 27/245 310/216.021
2,784,384 A * 3/1957 Vance ..... H01F 27/33 336/100
3,774,135 A * 11/1973 Kashima ..... H01F 27/04 336/172
5,777,539 A * 7/1998 Folker ..... H01F 27/2804 336/200

(Continued)

FOREIGN PATENT DOCUMENTS

JP 8-45751 A 2/1996

*Primary Examiner* — Mangtin Lian
(74) *Attorney, Agent, or Firm* — Crowell & Moring LLP

(57) ABSTRACT

The invention provides a stationary induction apparatus excellent in core vibration damping, being capable of realizing reduction in core excitation-noise. The stationary induction apparatus according to the invention includes a core made up of plural of core-legs formed by lamination of electromagnetic steel sheets, and a core-yoke formed by lamination of electromagnetic steel sheets to join the plural core-legs together; a core-tightening clasp for tightening a joint between the core-yoke and the core-legs, in the direction of the lamination of the electromagnetic steel sheets, to be secured, a winding, a tank, and an insulating sheet disposed between the core-tightening clasp and the core-yoke. Further, a concave hollowed-out part or a notched part is provided on the insulating sheet, positioned at a joint between the core-yoke and the core-leg, and a vibration insulator is disposed in the concave hollowed-out part or the notched part.

9 Claims, 11 Drawing Sheets

(56) References Cited

U.S. PATENT DOCUMENTS

| | | | | |
|---|---|---|---|---|
| 6,420,949 | B1 * | 7/2002 | Umemoto | F01L 9/04 335/251 |
| 2002/0157239 | A1 * | 10/2002 | Ngo | H01F 27/266 29/606 |
| 2011/0316659 | A1 * | 12/2011 | Puchianu | H01F 27/245 336/210 |

* cited by examiner

STATIONARY INDUCTION APPARATUS

CLAIM OF PRIORITY

The present application claims priority from Japanese Patent application serial No. 2014-126949, filed on Jun. 20, 2014, the content of which is hereby incorporated by reference into this application.

BACKGROUND OF THE INVENTION

1. Filed of the Invention

The present invention relates to a stationary induction apparatus, and particularly, to a stationary induction apparatus in which a structure for reduction of noise due to core excitation-vibration is improved.

2. Description of the Related Art

A traditional stationary induction apparatus, such as a transformer, a reactor, etc., is broadly made up of a core including plural core-legs formed by lamination of electromagnetic steel sheets, each thereof being composed of a magnetic material such as steel, etc., and a core-yoke, a core-tightening clasp for tightening a joint between the core-yoke and the core-leg in the direction of the lamination of the electromagnetic steel sheets, through the intermediary of an insulating material, and a tank in which not less than one winding, insulation-cylinder, and linear-spacer, respectively, are disposed around the core-leg, with an insulation-distance provided therebetween, thereby accommodating the core, the winding, the insulation-cylinder, and the linear-spacer, inside the tank filled up with a cooling insulating-medium.

With the core-yoke described as above, in order to ensure insulation thereof, an insulating sheet made of an insulating material is disposed along a lamination plane of the core-yoke to be tightened up by the core-tightening clasp through the intermediary of the insulating sheet. For the insulating sheet, use is made of a pressboard, etc., made up of a fiber, such as kraft pulp, etc., composed of cellulose as a main component, used as a raw material thereof, the fiber being subjected to processes of paper-making, lamination, and compression to be turned in a sheet-like shape. Further, for the core-tightening clasp, use is made of a clasp made of steel, or a stainless steel.

For example, with a stationary induction apparatus described in Patent Document 1, it is disclosed that a vibration insulator, such as a rubber sheet, and so forth, is disposed between an insulating sheet in contact with a core and a core-tightening clasp.

CITATION LIST

Patent Document 1: JP-A-08-45751

While requirements for lower-noise of the stationary induction apparatus have traditionally existed, there has lately been growing interest in noise-reduction, in particular, as a result of rise in public awareness of residential environment as well as noise-standardization at the time of transformer-energization, as decided at International Electrotechnical Commission (IEC), in 2001.

The noise of the stationary induction apparatus is primarily an excitation noise of a core, caused by vibrations of the core. The vibrations of the core are primarily due to magnetostriction of the electromagnetic steel sheet, and a magnetic attractive force occurring between the electromagnetic steel sheets, caused by transition of magnetic fluxes across a core joint.

FIG. 18 shows a traditional transformer core, as a whole, and FIG. 19 shows a joint of the traditional transformer core.

As shown in FIGS. 18 and 19, a transformer core 1 has a structure in which electromagnetic steel sheets 2 are laminated with each other, and in order to maintain the structure with the transformer core 1 kept in a stand-up state, it is necessary for the transformer core 1 to be tightened in a direction in which the electromagnetic steel sheets 2 are laminated by use of a core-tightening clasp 3. At this point in time, magnetostriction occurs in a direction in which magnetic fluxes of the electromagnetic steel sheets 2 of the transformer core 1 flow (the direction of rolling), thereby causing vibrations due to a magnetic attractive force of the joint of the transformer core 1 to occur in the direction of the lamination of the electromagnetic steel sheets 2.

An exciting force due to the magnetostriction is represented by expression 1 as follow:

$$F_S = \in ES \qquad \text{expression 1}$$

where $F_S$ is an exciting force due to magnetostriction, $\in$ is magnetostriction, E is Yong's modulus of an electromagnetic steel sheet 2, in the direction of rolling, and S is a cross-sectional area of the transformer core 1.

Meanwhile, the magnetic attractive force of a joint of the transformer core 1 is represented by expression 2 as follow:

$$F_E = \frac{B^2 S}{2\mu_0} \qquad \text{expression 2}$$

where $F_E$ is the magnetic attractive force of the joint of the transformer core 1, B magnetic flux density, S a cross-sectional area of a portion of the transformer core 1, where the transition of magnetic fluxes occurs, $\mu 0$ is magnetic permeability of an insulating-medium disposed around the transformer core 1. In order to reduce the excitation-noise of the transformer core 1, there will arise the need for a structure of the transformer core 1, capable of decreasing a value $F_S$ as well as $F_E$.

With the traditional transformer core 1 as disclosed in Patent Document 1 (as shown in FIG. 8), a vibration insulator 4 made up of an elastic body, such as, for example, a rubber sheet, etc., is disposed between an insulating sheet 5 in contact with a core 2A and a core-tightening clasp 3, as shown in FIG. 18, thereby enabling the vibration energy of the core 2A to be dissipated through deformation of the vibration insulator 4, so that this configuration is effective from the viewpoint of reducing vibrations propagating to the core-tightening clasp 3.

With this transformer, however, since heat generated from the core 2A at the time of a high load-factor differs from that at the time of a low load-factor, a temperature gradient exists in the vicinity of the core 2A, thereby causing not only thermal expansion and thermal shrinkage, respectively, to occur to the vibration insulator 4 disposed between the insulating sheet 5 and the core-tightening clasp 3, but also a gap to occur between the vibration insulator 4 and the core-tightening clasp 3, or between the vibration insulator 4 and the insulating sheet 5, due to permanent deformation of the vibration insulator 4, caused by directly tightening the vibration insulator 4 by use of the core-tightening clasp 3, so that there arises the need for the core-tightening clasp 3 having a configuration capable of adjusting the position in accordance with the thickness of the vibration insulator 4 without tightening the vibration insulator 4 only.

The present invention has been developed in view of the point described as above, and it is therefore an object of the invention to provide a stationary induction apparatus excellent in core vibration-damping, being capable of realizing reduction in core excitation-noise.

SUMMARY OF THE INVENTION

In order to achieve the object of the invention, described as above, the invention provides in its one aspect a stationary induction apparatus including a core including plural core-legs formed by lamination of electromagnetic steel sheets, and a core-yoke formed by lamination of electromagnetic steel sheets, to join the plural core-legs together, a core-tightening clasp for tightening a joint between the core-yoke and the core-leg in the direction of lamination to be secured, a winding, a tank, and an insulating sheet disposed between the core-tightening clasp and the core-yoke. Further, a concave hollowed-out part or a notched part is provided on the insulating sheet, positioned at a joint between the core-leg and the core-yoke, and a vibration insulator is disposed in the concave hollowed-out part or the notched part, or in the case of, for example, a 3-phase and 3-leg core, a concave hollowed-out part or a notched part is provided in portions of the insulating sheet, positioned at respective joints including a joint between the core-yoke and the core-leg at the center, and joints between the core-yoke and the core-leg on the respective lateral sides of the core-yoke, whereupon a vibration insulator is disposed in the concave hollowed-out part or the notched part.

The present invention can provide a stationary induction apparatus excellent in core vibration-damping, being capable of realizing reduction in core excitation-noise.

DETAILED DESCRIPTION OF THE PREFERRED EMBODIMENTS

Working Embodiments of a stationary induction apparatus according to the invention are described hereunder with reference to the accompanied drawing. For each constituent element of the stationary induction apparatus according to the invention, identical to that of the traditional stationary induction apparatus, use is made of reference sign identical to that for the traditional stationary induction apparatus.

First Embodiment

Figure 1:
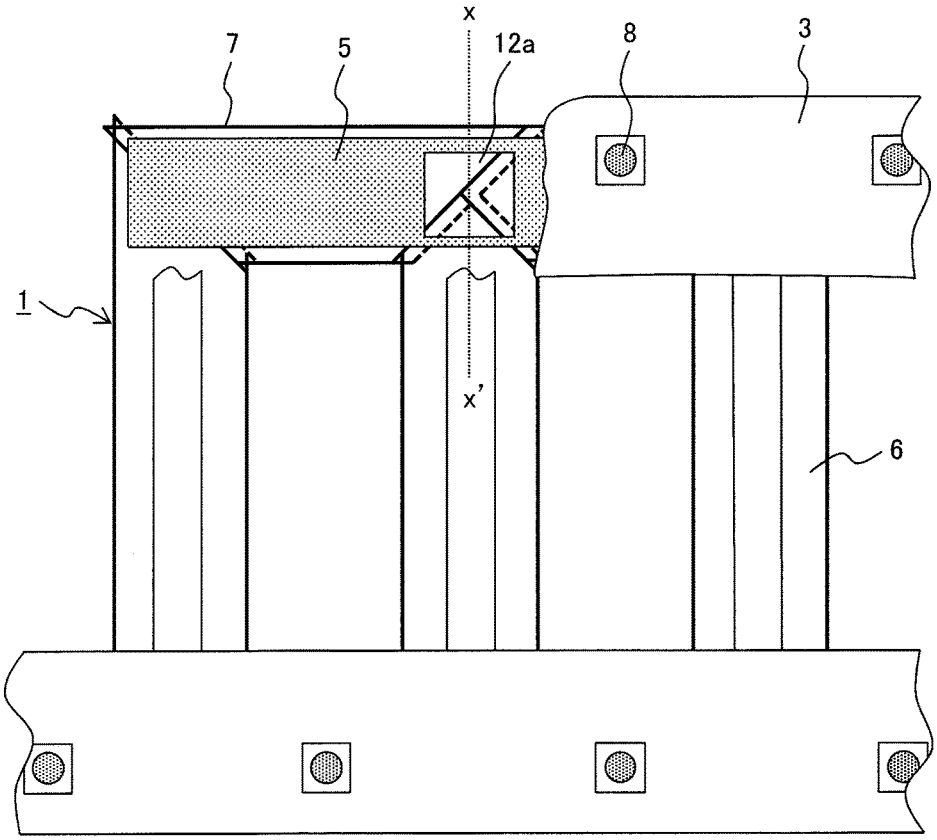
FIG. 1 is a schematic diagram showing a core structure of a transformer making up a stationary induction apparatus according to a first embodiment of the invention.
Figure 2:
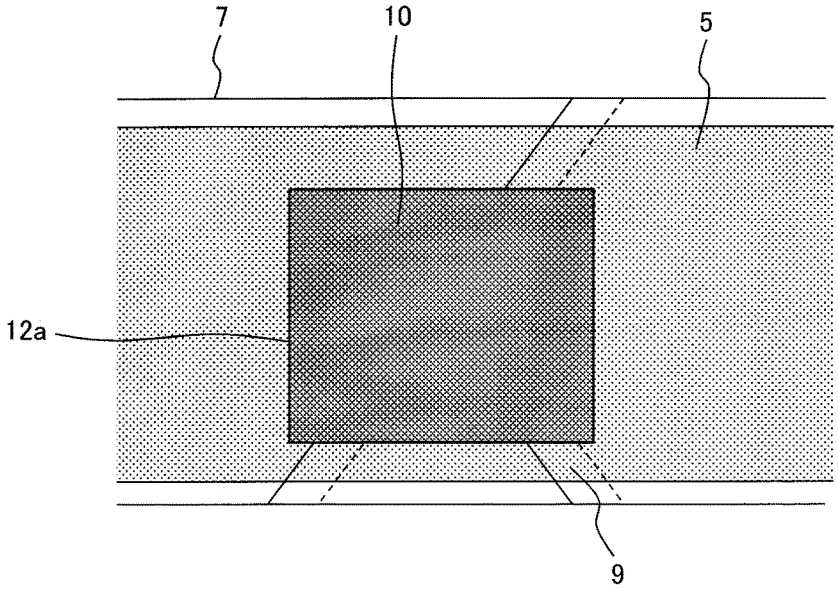
FIG. 2 is an enlarged view showing a hollowed-out part or a notched part, shown in FIG. 1.

FIGS. 1 and 2, each show a transformer making up a stationary induction apparatus according to a first embodiment of the invention. The transformer according to the present embodiment has a structure in which a upper core-yoke and a lower core-yoke, identical in structure to the upper core-yoke, are disposed in such a way as to be vertically symmetric with each other. Furthermore, this transformer is substantially identical in configuration to the traditional transformer described as above, omitting therefore description thereof in detail.

In the case of, for example, a 3-phase and 3-leg oil-filled transformer, as shown in FIGS. 1 and 2, a transformer core 1 of the transformer according to the present embodiment is made up of core legs 6 and a upper core-yoke 7, and an inner-side winding (not shown) is wound around the core leg 6, and an outer-side winding (not shown) is wound around the inner-side winding, while an insulating-space is provided around the inner-side winding. An insulating-space portion includes a linear spacer (not shown), an insulation cylinder (not shown), and an insulating paper (not shown), and all the constituents of the insulating-space portion are housed in a transformer tank filled up with an insulating medium (not shown). At this point in time, the upper core-yoke 7 is tightened through the intermediary of an insulating sheet 5 by a core-tightening clasp 3 and clamps 8.

And with the present embodiment, a concave hollowed-out part or a notched part 12*a*, formed rectangular in shape, is provided on an insulating sheet 5, positioned at a joint 9 between the core-leg 6 at the center and the core yoke (upper core-yoke) 7, more specifically, a portion of the joint 9 between the core-leg 6 at the center and the core yoke 7, where an electromagnetic steel sheet of the core-leg 6 and an electromagnetic steel sheet of the core yoke 7 overlap each other, as shown in FIG. 2, whereupon a vibration insulator 10 rectangular in shape is disposed in the concave hollowed-out part 12*a* or the notched part 12*a*.

The concave hollowed-out part, or the notched part 12*a* is formed by pressing the insulating sheet 5 or cutting out a portion of the insulating sheet 5.

Further, the vibration insulator 10 disposed in the concave hollowed-out part or the notched part 12*a* is preferably larger in thickness than the insulating sheet 5.

Still further, the vibration insulator 10 is preferably composed of a macromolecular material containing no plasticizer, and the vibration insulator 10 composed of the macromolecular material is preferably undissolvable in the insulating medium containing no plasticizer, and filled in the transformer tank. In the case where the insulating medium is, for example, a mineral oil, use is preferably made of fluoro rubber, silicone rubber, and etc.

Still further, an insulating paper 50 to 150 μm in thickness per one sheet, such as a kraft paper, an aramid paper, and etc., using kraft pulp, or an aramid fiber, as a raw material, may be disposed between the vibration insulator 10 made of the macromolecular material and the core yoke 7.

Yet further, the insulating paper is preferably lower in density than the insulating sheet 5. More specifically, the density of the insulating paper is preferably is not more than 1.35 g/cm$^3$, and more preferably in a range of 0.80 to 1.00 g/cm$^3$.

Further, the insulating paper is preferably lower in relative dielectric constant than the insulating sheet 5. More specifically, the relative dielectric constant of the insulating paper in such a state as to be immersed in the insulating medium filled in the transformer tank is preferably not more than 5.1 below 80° C., and more preferably in a range of 2.1 to 3.2 below 80° C. Furthermore, the insulating paper may contain both the kraft pulp and the aramid fiber.

With such a configuration of the present embodiment as described in the foregoing, even if a temperature inside the transformer tank at the time of the high load-factor differs from that at the time of the low load-factor, thereby causing a temperature gradient to exist in the vicinity of the transformer core 1, a gap will not occur to the vibration insulator 10 disposed between the insulating sheet 5 and the core-tightening clasp 3, due to thermal expansion and thermal shrinkage, occurring to the vibration insulator 10, and further, the vibration insulator 10 only will no longer be tightened up by the core-tightening clasp 3, so that a gap will not occur either between the vibration insulator 10 and the core-tightening clasp 3, or between the vibration insulator 10 and the insulating sheet 5, due to permanent deformation of the vibration insulator 10. Thus, it is possible to obtain a transformer not only excellent in core vibration damping, but also capable of reducing the core excitation-noise.

Second Embodiment

Figure 3:
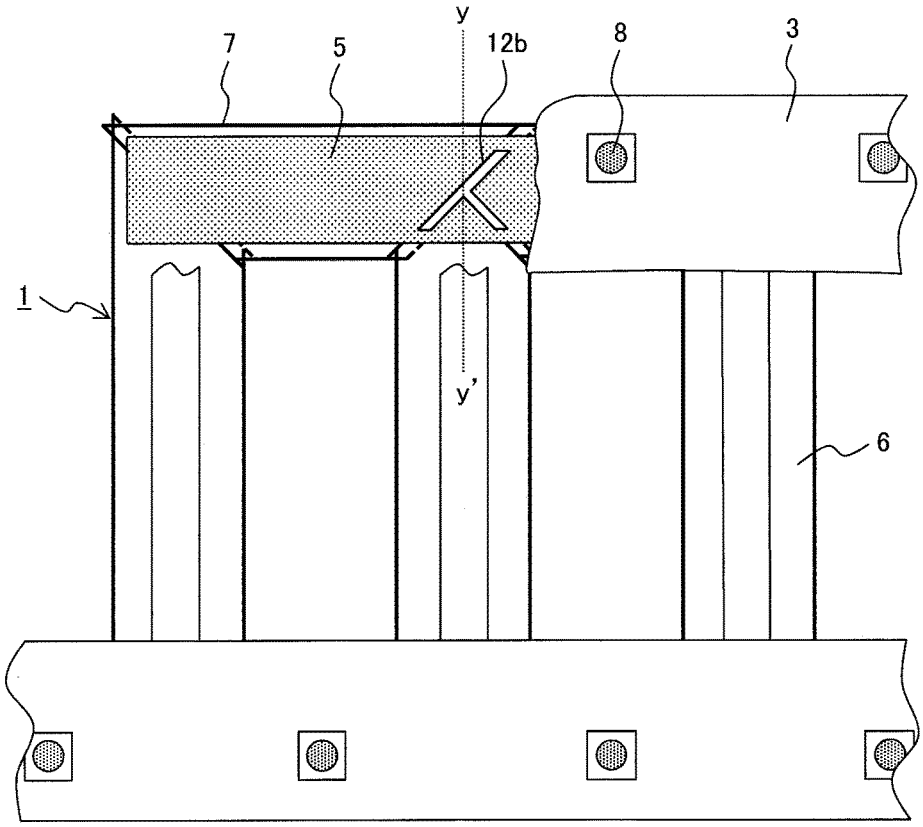
FIG. 3 is a schematic diagram showing a core structure of a transformer making up a stationary induction apparatus according to a second embodiment of the invention.
Figure 4:
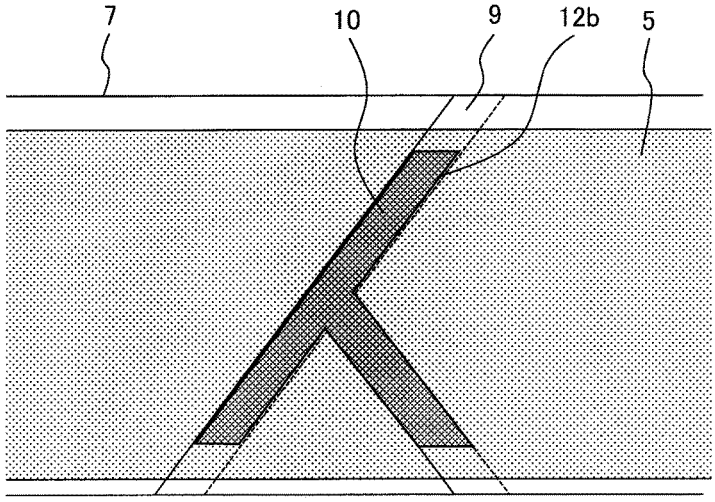
FIG. 4 is an enlarged view showing a hollowed-out part or a notched part, shown in FIG. 3.

FIGS. 3 and 4 each show a transformer making up a stationary induction apparatus according to a second embodiment of the invention.

With the present embodiment shown in FIGS. 3 and 4, a concave hollowed-out part or a notched part 12*b* is provided at a joint 9 between the core-leg 6 at the center and the upper core-yoke 7, more specifically, at a portion of the joint 9 between the core-leg 6 at the center and the upper core-yoke 7, where the electromagnetic steel sheet of the core-leg 6 and the electromagnetic steel sheet of the upper core-yoke 7 overlap each other, the concave hollowed-out part 12*b* or the notched part 12*b* being formed in a shape resembling the letter λ in such a way as to superimpose on the portion of the joint 9, where the electromagnetic steel sheet of the core-leg 6 overlaps the electromagnetic steel sheet of the upper core-yoke 7, whereupon a vibration insulator 10 formed in the shape resembling the letter λ is disposed in the concave hollowed-out part or the notched part 12*b*, formed in the shape resembling the letter λ. Further, with a lower core-yoke, a configuration is vertically inverted in shape (that is, the concave hollowed-out part or the notched part is formed in a shape resembling the letter λ turned upside down in a lower core-yoke, and a vibration insulator 10 formed in the shape resembling the letter λ turned upside down is disposed in the concave hollowed-out part or the notched part, formed in the shape resembling the letter λ turned upside down). Other configuration of the present embodiment is the same as the first embodiment.

Even in the case of the configuration of the present embodiment being as described above, the same effect as with the case of the first embodiment can be obtained.

Third Embodiment

Figure 5:
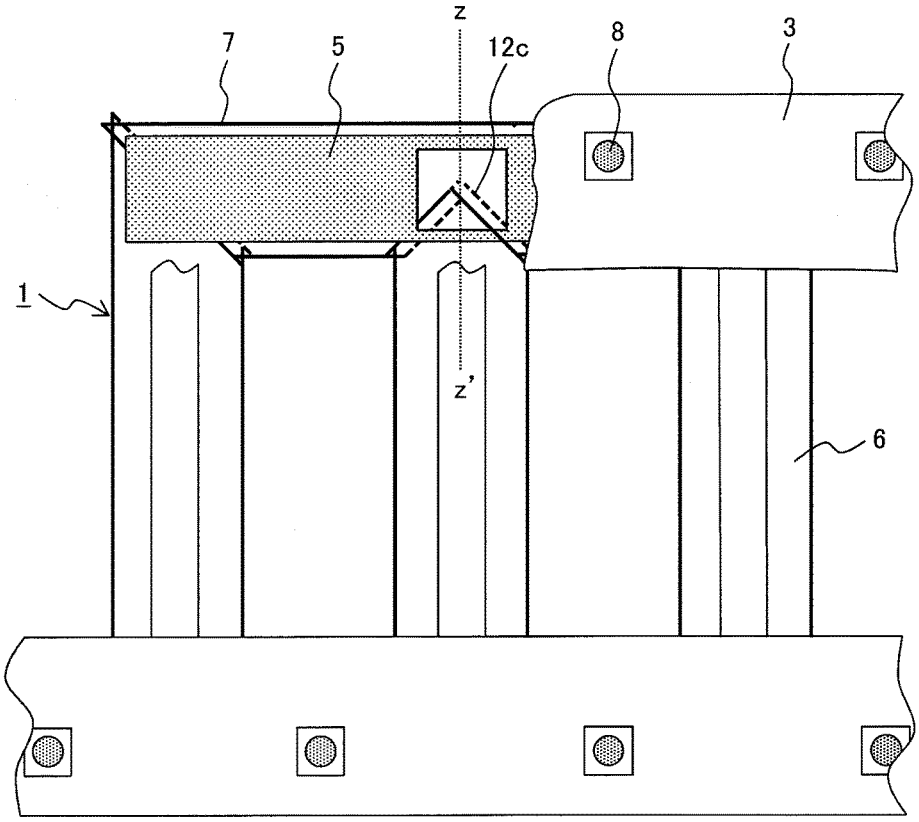
FIG. 5 is a schematic diagram showing a core structure of a transformer making up a stationary induction apparatus according to a third embodiment of the invention.
Figure 6:
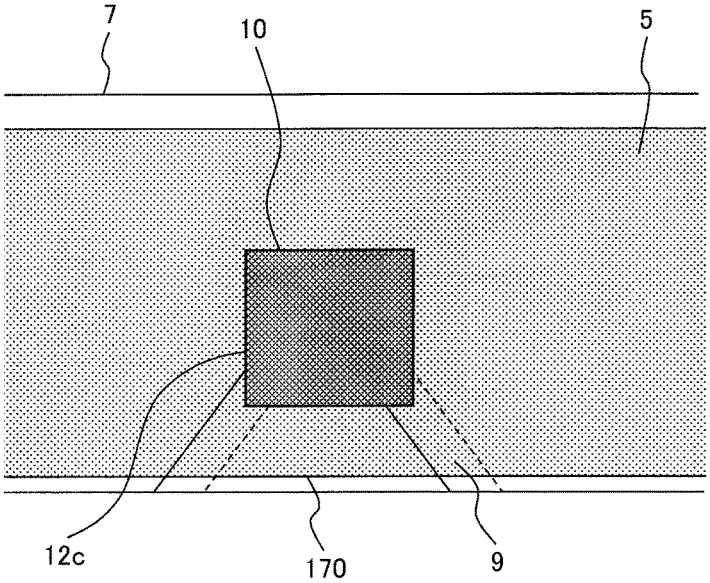
FIG. 6 is an enlarged view showing a hollowed-out part or a notched part, shown in FIG. 5.

FIGS. 5 and 6 each show a transformer making up a stationary induction apparatus according to a third embodiment of the invention.

With the present embodiment shown in FIGS. 5 and 6, a joint 9 between the core-leg 6 at the center and the upper core-yoke 7, more specifically, a portion of the joint 9 between the core-leg 6 at the center and the upper core-yoke 7, where the electromagnetic steel sheet of the core-leg 6, and the electromagnetic steel sheet of the core-yoke 7 overlap each other, is formed in an inverted V-shape, and a concave hollowed-out part or a notched part 12*c*, formed rectangular in shape, is provided in the insulating sheet 5, positioned at the joint 9 between the core-leg 6 at the center and the upper core-yoke 7, in the inverted V-shape, whereupon a vibration insulator 10 rectangular in shape is disposed in the concave hollowed-out part or the notched part 12*c* formed rectangular in shape.

Further, with a lower core-yoke (not shown), a portion thereof, where the electromagnetic steel sheets overlap each other, is formed in a V-shape, and a concave hollowed-out part or a notched part, formed rectangular in shape, is provided at the position of a joint formed in the V-shape between the core-yoke and the core-leg at the center, whereupon a vibration insulator rectangular in shape is disposed in the concave hollowed-out part or notched part, formed rectangular in shape. Other configuration of the present embodiment is the same as the first embodiment.

Even in the case of the configuration of the present embodiment being as described above, the same effect as with the case of the first embodiment can be obtained.

Fourth Embodiment

Figure 7:
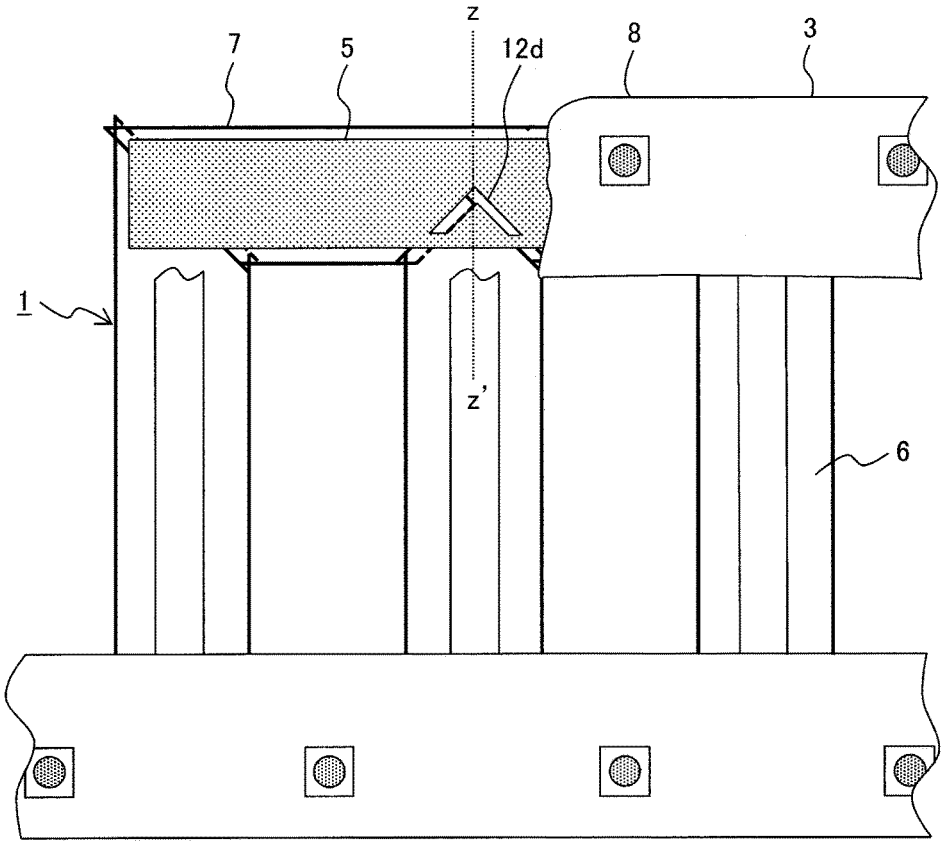
FIG. 7 is a schematic diagram showing a core structure of a transformer making up a stationary induction apparatus according to a fourth embodiment of the invention.
Figure 8:
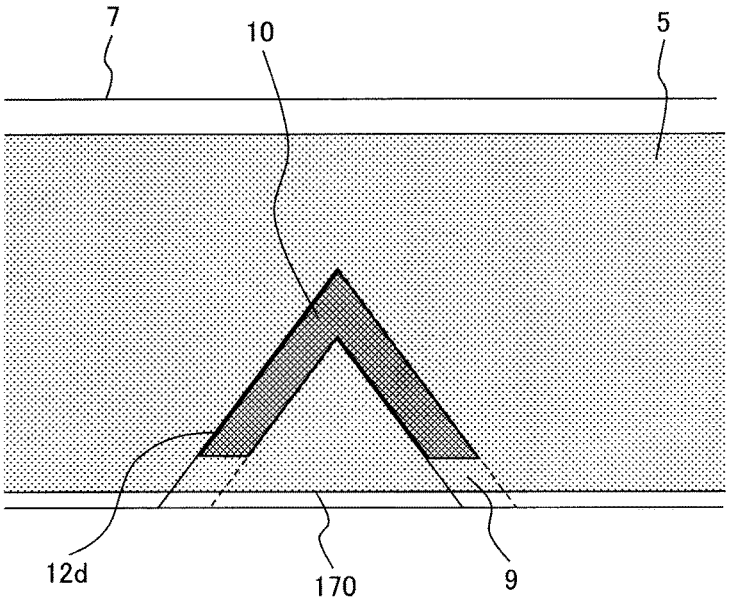
FIG. 8 is an enlarged view showing a hollowed-out part or a notched part, shown in FIG. 7.

FIGS. 7 and 8 each show a transformer making up a stationary induction apparatus according to a fourth embodiment of the invention.

With the present embodiment shown in FIGS. 7 and 8, a concave hollowed-out part or a notched part 12*d*, formed in an inverted V-shape, is provided at a portion of the insulating sheet 5, positioned at a joint 9 between the core-leg 6 at the center and the upper core-yoke 7, more specifically, a portion of the joint 9 between the core-leg 6 at the center and the upper core-yoke 7, where the electromagnetic steel sheet of the core-leg 6, and the electromagnetic steel sheet of the upper core-yoke 7 overlap each other, whereupon a vibration insulator 10 formed in the inverted V-shape is disposed in the concave hollowed-out part or the notched part 12*d* formed in the inverted V-shape.

Further, with a lower core-yoke (not shown), a concave hollowed-out part or a notched part is formed in a V shape, and a vibration insulator formed in the V shape is disposed in the concave hollowed-out part or the notched part, formed in the V shape. Other configuration of the present embodiment is the same as the first embodiment.

Even in the case of the configuration of the present embodiment being as described above, the same effect as with the case of the first embodiment can be obtained.

Fifth Embodiment

Figure 9:
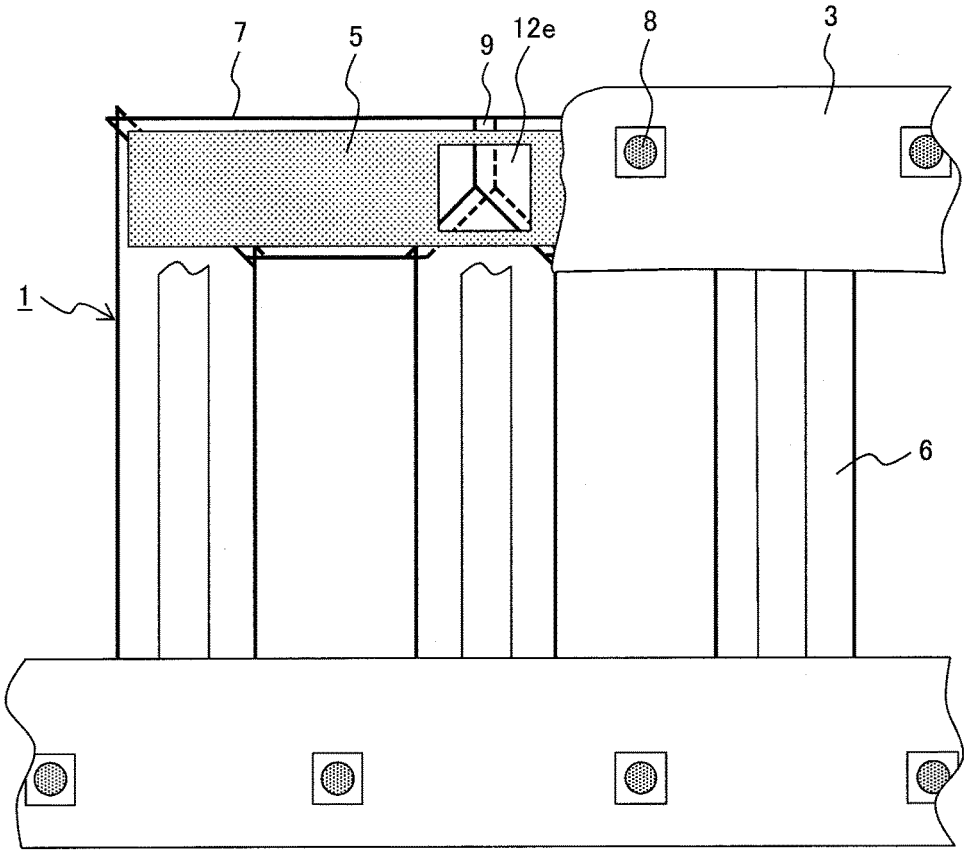
FIG. 9 is a schematic diagram showing a core structure of a transformer making up a stationary induction apparatus according to a fifth embodiment of the invention.
Figure 10:
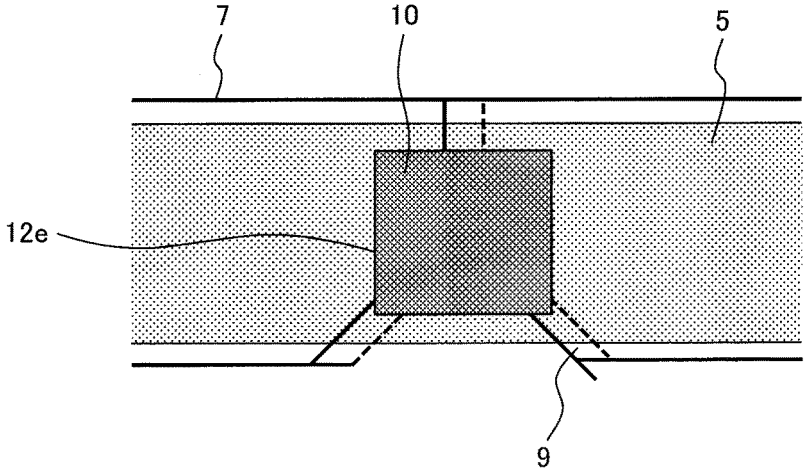
FIG. 10 is an enlarged view showing a hollowed-out part or a notched part, shown in FIG. 9.

FIGS. 9 and 10 each show a transformer making up a stationary induction apparatus according to a fifth embodiment of the invention.

With the present embodiment shown in FIGS. 9 and 10, a joint 9 between the core-leg 6 at the center and the core upper-yoke 7, more specifically, a portion of the joint 9 between the core-leg 6 at the center and the core upper-yoke 7, where the electromagnetic steel sheet of the core-leg 6, and the electromagnetic steel sheet of the upper core-yoke 7 overlap each other, is formed in an inverted Y-shape, and a concave hollowed-out part or a notched part 12*e*, formed rectangular in shape, is provided on an insulating sheet 5, positioned at the joint 9 between the core-leg 6 at the center and the upper core-yoke 7, in the inverted Y-shape, whereupon a vibration insulator 10 formed rectangular in shape is disposed in the concave hollowed-out part or the notched part 12*e*, formed rectangular in shape.

Further, with a lower core-yoke (not shown), a portion thereof, where the electromagnetic steel sheets overlap each other, is formed in a Y-shape, and a concave hollowed-out part or a notched part, formed in a rectangular shape, is provided in an insulating sheet, at the position of a joint between the core-yoke and the core-leg at the center, formed in the Y-shape, whereupon a vibration insulator formed in the rectangular shape is disposed in the concave hollowed-out part or the notched part, formed in the rectangular shape. Other configuration of the present embodiment is the same as the first embodiment.

Even in the case of the configuration of the present embodiment being as described above, the same effect as with the case of the first embodiment can be obtained.

Sixth Embodiment

Figure 11:
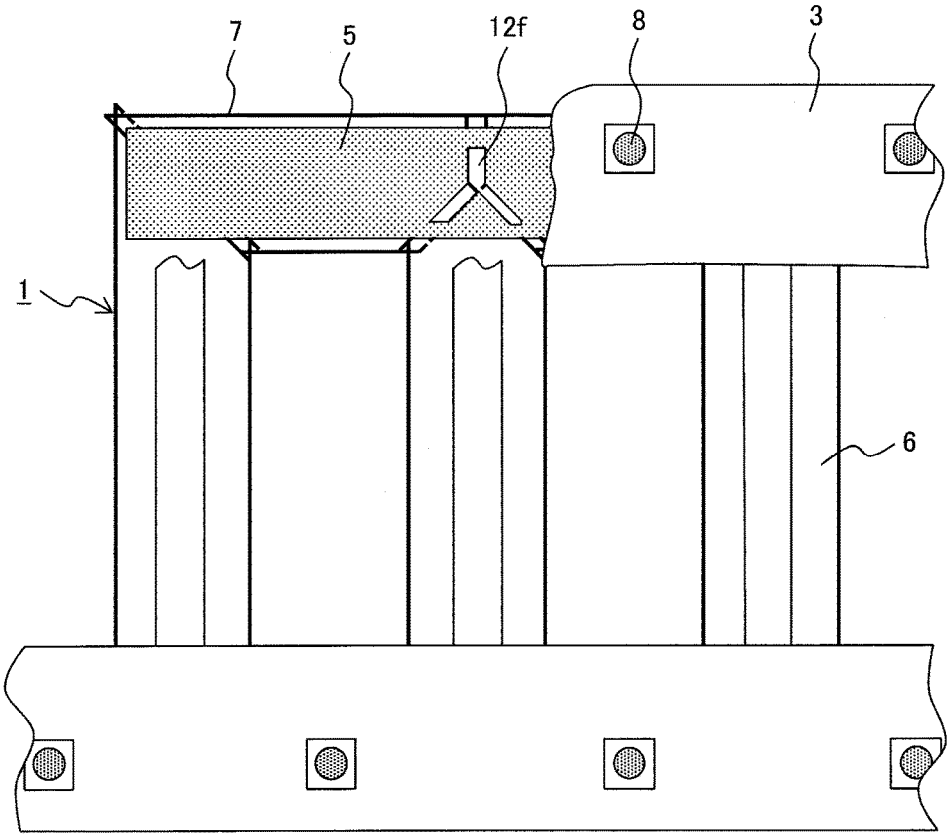
FIG. 11 is a schematic diagram showing a core structure of a transformer making up a stationary induction apparatus according to a sixth embodiment of the invention.
Figure 12:
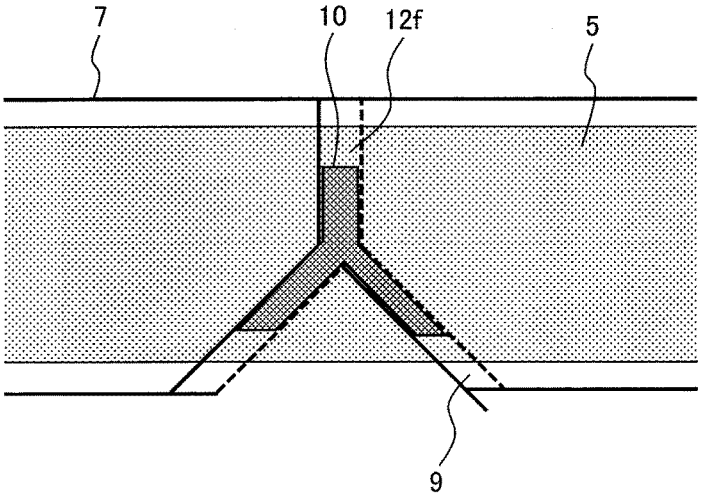
FIG. 12 is an enlarged view showing a hollowed-out part or a notched part, shown in FIG. 11.

FIGS. 11 and 12 each show a transformer making up a stationary induction apparatus according to a sixth embodiment of the invention.

With the present embodiment shown in FIGS. 11 and 12, a joint 9 between the core-yoke 7 and the core-leg 6 at the center, more specifically, a portion of the joint 9 between the core-yoke 7 and the core-leg 6 at the center, where the electromagnetic steel sheet of the core-leg 6, and the electromagnetic steel sheet of the upper core-yoke 7 overlap each other, is formed in an inverted Y-shape, and a concave hollowed-out part or a notched part 12*f*, formed in the inverted Y-shape, is provided in the insulating sheet 5, at the position of the joint 9 between the upper core-yoke 7 and the core-leg 6, in the inverted Y-shape, whereupon a vibration insulator 10, in the inverted Y-shape, is disposed in the concave hollowed-out part or a notched part 12*f*, formed in the inverted Y-shape.

Further, with a lower core-yoke (not shown), a concave hollowed-out part or a notched part is formed in a Y-shape, and a vibration insulator is disposed in such a way as to be in the Y-shape. Other configuration of the present embodiment is the same as the first embodiment.

Even in the case of the configuration of the present embodiment being as described above, the same effect as with the case of the first embodiment can be obtained.

Seventh Embodiment

Figure 13:
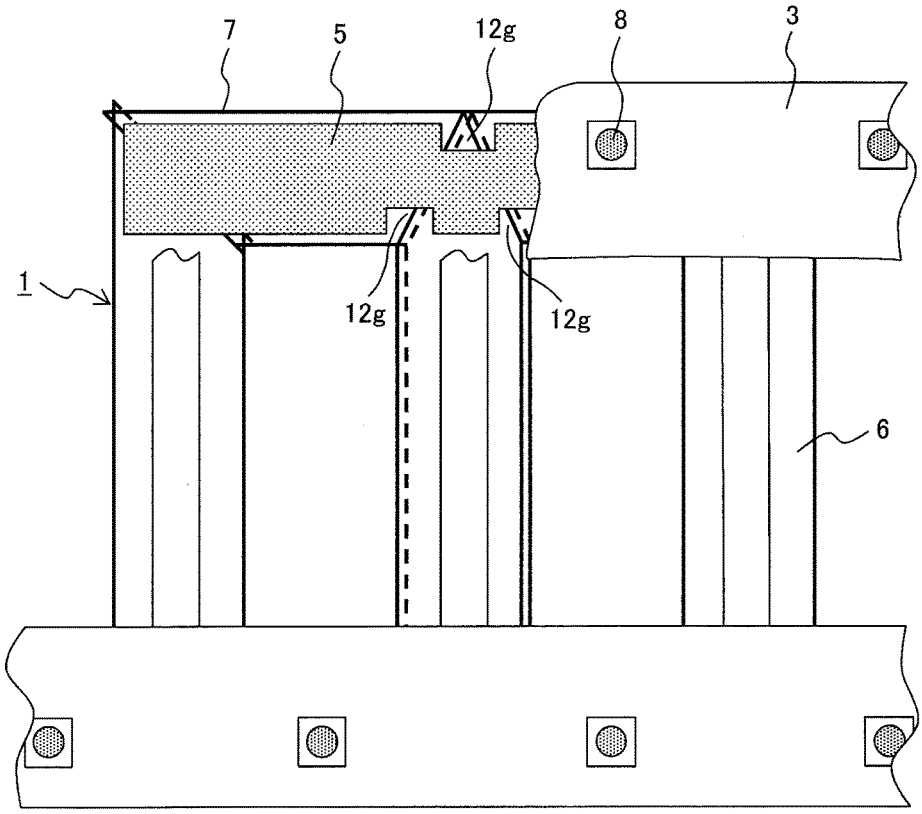
FIG. 13 is a schematic diagram showing a core structure of a transformer making up a stationary induction apparatus according to a seventh embodiment of the invention.
Figure 14:
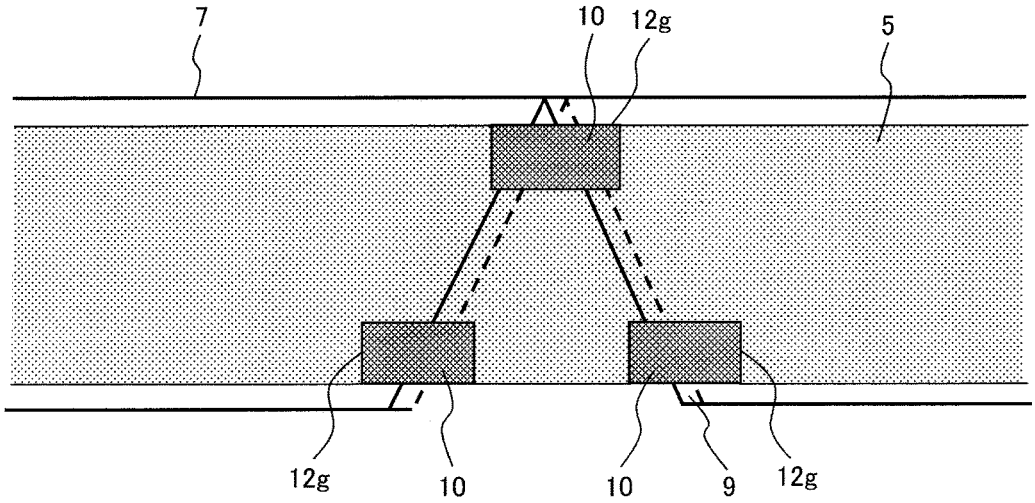
FIG. 14 is an enlarged view showing a hollowed-out part or a notched part, shown in FIG. 13.

FIGS. 13 and 14 each show a transformer making up a stationary induction apparatus according to a seventh embodiment of the invention.

With the present embodiment shown in FIGS. 13 and 14, a joint 9 between the core-yoke 7 and the core-leg 6 at the center, more specifically, a portion of the joint 9 between the core-yoke 7 and the core-leg 6 at the center, where the electromagnetic steel sheet of the core-leg 6, and the electromagnetic steel sheet of the upper core-yoke 7 overlap each other, is formed in an inversed V-shape, and plural pieces of concave hollowed-out parts or notched parts 12*g* (with the present embodiment, the concave hollowed-out part or the notched part 12*g* at three locations), each thereof being formed rectangular in shape, are provided in the insulating sheet 5, positioned at the joint 9 between the upper core-yoke 7 and the core-leg 6 at the center, whereupon each of vibration insulators 10, disposed in such a way as to form the rectangular shape, is disposed in each of the plural hollowed-out parts or notched parts 12*g*, formed rectangular in shape.

Further, with a lower core-yoke (not shown), a concave hollowed-out part or a notched part is formed in a V-shape, and vibration insulators are disposed in such a fashion as to form the V-shape. Other configuration of the present embodiment is the same as the first embodiment.

Even in the case of the configuration of the present embodiment being as described above, the same effect as with the case of the first embodiment can be obtained.

Eighth Embodiment

Figure 15:
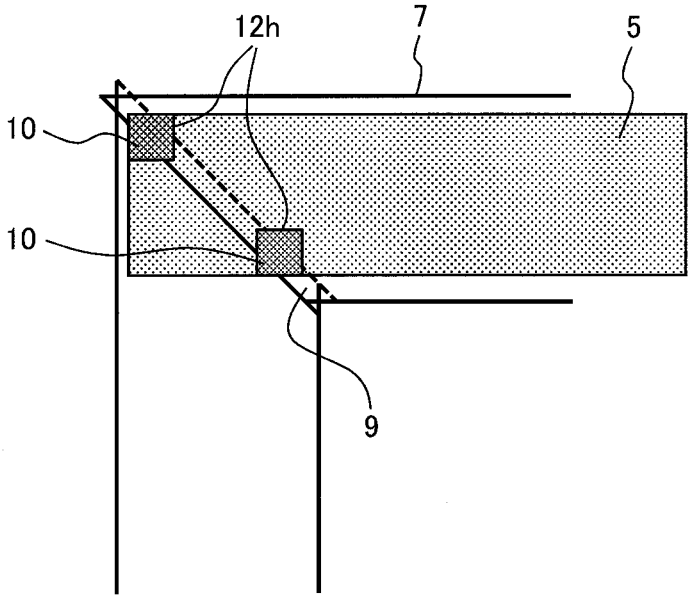
FIG. 15 is an enlarged view showing a joint between a core-yoke and a core-leg, at an end of the core-yoke, in a transformer making up a stationary induction apparatus according to an eighth embodiment of the invention.

FIG. 15 shows a transformer making up a stationary induction apparatus according to an eighth embodiment of the invention.

With the present embodiment shown in FIG. 15, a concave hollowed-out part or a notched part 12*h*, identical in structure to that selected from among the concave hollowed-out parts or notched parts, 12*a* through 12*g*, provided at the center of the core-yoke 7, as described with reference to the first through seventh embodiments, is formed at respective joints 9 between the core-yoke 7 and the respective core-legs 6, at the respective ends of the core-yoke 7, on the lateral side thereof, as well, besides the respective concave hollowed-out parts or notched parts, 12*a* through 12*g*, whereupon a vibration insulator 10 is disposed in the concave hollowed-out part or a notched part 12*h*.

More specifically, the concave hollowed-out part or the notched part 12*h*, formed at the respective joint 9 between the core-leg 6 and the respective lateral sides of the core-yoke 7, is formed rectangular in shape, and the vibration insulator 10 is disposed in this concave hollowed-out part or this notched part 12*h*. Further, with a lower core-yoke, a configuration is vertically inverted in shape. Other configuration of the present embodiment is the same as the first embodiment.

Even in the case of the configuration of the present embodiment being as described above, the same effect as with the case of the first embodiment can be obtained.

Ninth Embodiment

Figure 16:
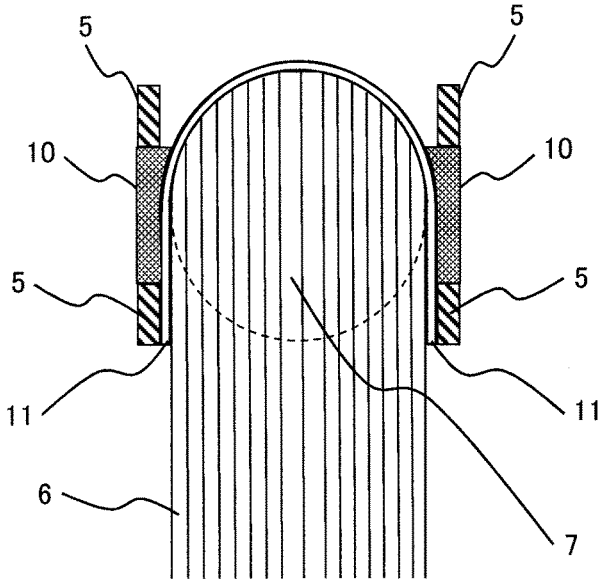
FIG. 16 a cross-sectional view taken on line x-x' of FIG. 1, in a transformer making up a stationary induction apparatus according to a ninth embodiment of the invention.

FIG. 16 shows a transformer making up a stationary induction apparatus according to a ninth embodiment of the invention. FIG. 16 is a cross-sectional view taken on line x-x' of FIG. 1.

The present embodiment has a feature in that an insulating paper 11 is disposed between a core-yoke 7 and an insulating sheet 5 as well as between the core-yoke 7 and a vibration insulator 10. The insulating paper 11 is made up of a kraft paper, or an aramid paper, using kraft pulp, or an aramid fiber, respectively, as the raw material thereof, or the insulating paper 11 may include both the kraft pulp, and the aramid fiber.

Even in the case of the configuration of the present embodiment being as described above, the same effect as with the case of the first embodiment can be certainly obtained, and in addition, more reduction in vibration of the transformer core is achieved by agency of the insulating paper 11.

Tenth Embodiment

Figure 17:
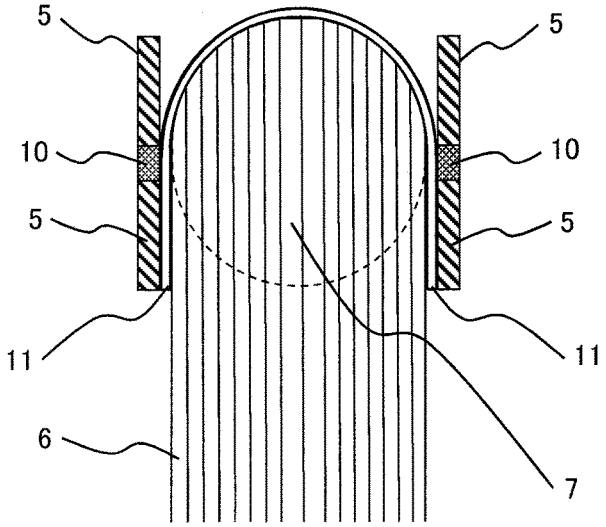
FIG. 17 a cross-sectional view taken on line y-y' of FIG. 3 or line Z-Z' of FIG. 5, in a transformer making up a stationary induction apparatus according to a tenth embodiment of the invention.
Figure 18:
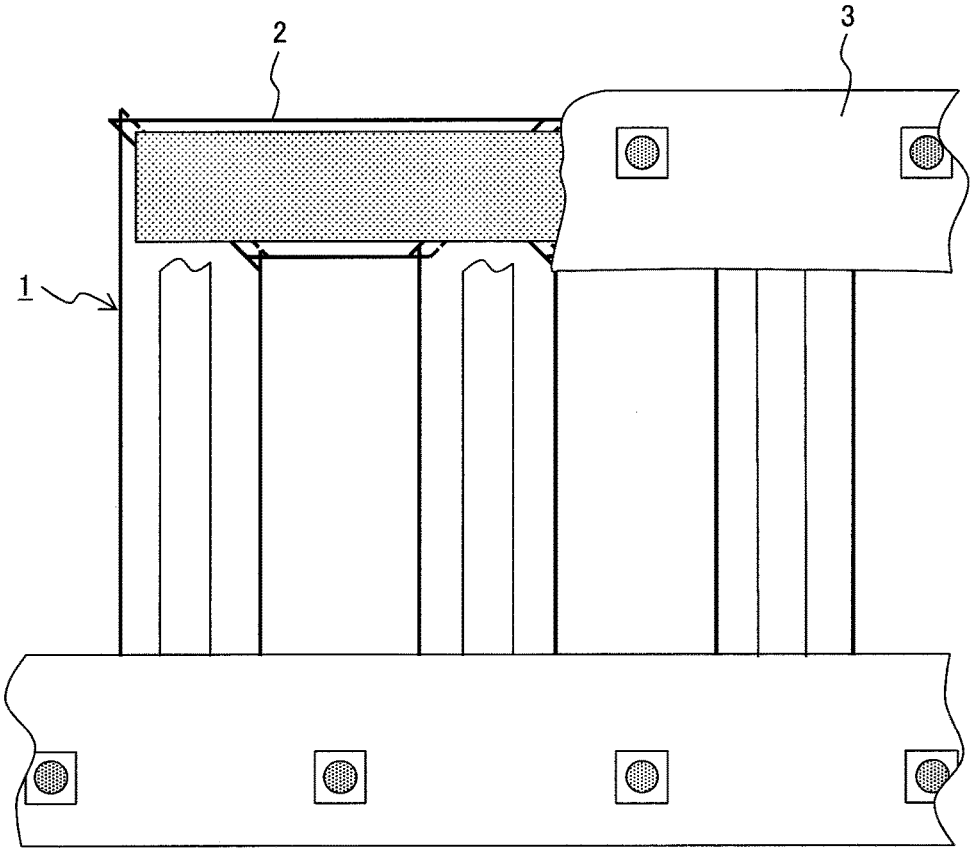
FIG. 18 is a schematic diagram showing a core structure of a traditional transformer.
Figure 19:
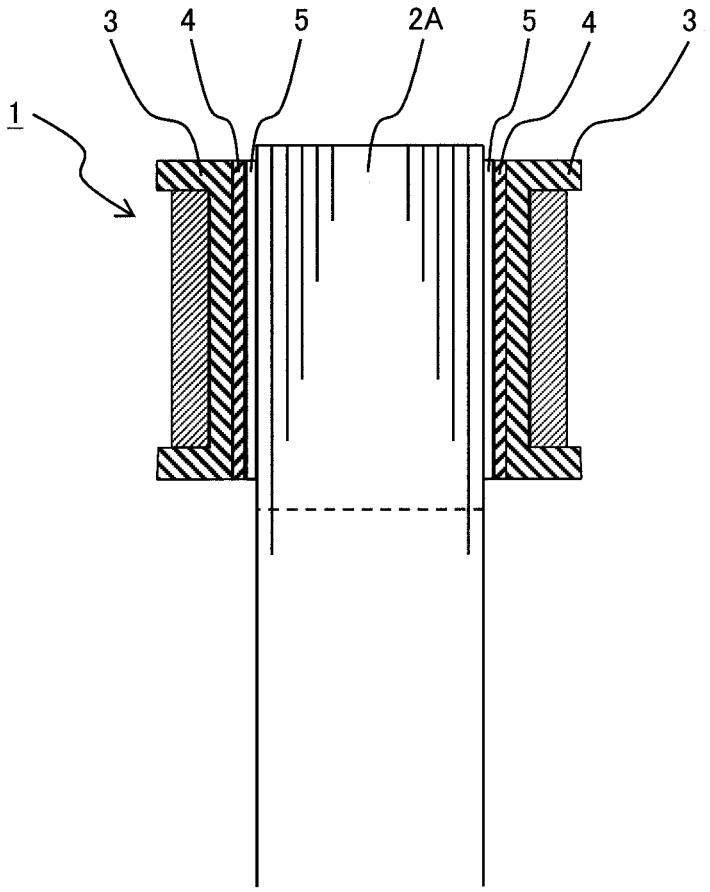
FIG. 19 is a schematic diagram showing an upper part of the core structure of the traditional transformer, in cross-section.

FIG. 17 shows a transformer making up a stationary induction apparatus according to a tenth embodiment of the invention. FIG. 17 is a cross-sectional view taken on line y-y' of FIG. 3, or a cross-sectional view taken on line z-z' of FIG. 5.

The present embodiment has a feature in that an insulating paper 11 is disposed between a core-yoke 7 and an insulating sheet 5 as well as between the core-yoke 7 and a vibration insulator 10. The insulating paper 11 is made up of a kraft paper, or an aramid paper, using kraft pulp, or an aramid fiber, respectively, as the raw material thereof, or the insulating paper 11 may include both the kraft pulp, and the aramid fiber.

Even in the case of the configuration of the present embodiment being as described above, the same effect as with the case of the first embodiment can be certainly obtained, and in addition, more reduction in vibration of the transformer core is achieved by the agency of the insulating paper 11.

While preferred embodiments of the present invention have been described in the foregoing, it is to be understood that the invention be not limited thereto, and that various variations thereto may be made without departing from the spirit of the invention. For example, the embodiments described in the forgoing are for illustrative purpose only to assist the invention to be understood with greater ease, and it is to be pointed that the invention be not necessarily limited to a stationary induction apparatus provided with all the constituent elements as described in the foregoing. Further, a part of the configuration of a certain embodiment of the invention may be replaced with the configuration of anther embodiment, or the configuration of anther embodiment may be added to the configuration of a certain embodiment. Still further, addition•deletion•replacement by use of another configuration may be applied with respect to a part of the configuration of each embodiment.

LIST OF REFERENCE SIGNS

1: transformer core,
2: electromagnetic steel sheet,
2A: core,
3: core-tightening clasp,
4, 10: vibration insulator,
5: insulating sheet,
6: core-leg,
7: core-yoke,
8: clamp,
9: joint between the core-leg and the core-yoke,
11: insulating paper,
12*a*, 12*b*, 12*c*, 12*d*, 12*e*, 12*f*, 12*g*, 12*h*: concave hollowed-out part or a notched part.

What is claimed is:

1. A stationary induction apparatus comprising:

a core comprising a plurality of core-legs formed by lamination of electromagnetic steel sheets, and a core-yoke formed by lamination of electromagnetic steel sheets to join the plurality of core-legs together;

a core-tightening clasp for tightening a joint between the core-yoke and the core-leg, in the direction of lamination of the electromagnetic steel sheets to be secured;

a winding; and an insulating sheet disposed between the core-tightening clasp and the core-yoke, wherein a concave hollowed-out part or a notched part is provided on the insulating sheet, positioned at the joint between the core-leg and the core-yoke, and a vibration insulator is disposed in the concave hollowed-out part or the notched part.

2. The stationary induction apparatus according to claim 1, wherein the concave hollowed-out part or the notched part is provided in a portion of the joint, where the electromagnetic steel sheet of the core-leg and the electromagnetic steel sheet of the corer-yoke overlap each other.

3. The stationary induction apparatus according to claim 1, wherein the concave hollowed-out part or the notched part is formed rectangular in shape, and the vibration insulator is disposed in the concave hollowed-out part or the notched part, formed rectangular in shape.

4. The stationary induction apparatus according to claim 1, wherein the concave hollowed-out part or the notched part is formed in a shape resembling the letter λ, in an upper core-yoke, while being formed in a shape resembling the letter λ turned upside down, in a lower core-yoke, and the vibration insulator is disposed in the concave hollowed-out parts or the notched parts, formed in the shape resembling the letter λ, and in the shape resembling the letter λ turned upside down, respectively.

5. The stationary induction apparatus according to claim 1, wherein the concave hollowed-out part or the notched part is formed in an inversed V-shape, in an upper core-yoke, while being formed in a V-shape, in a lower core-yoke, and the vibration insulator is disposed in the concave hollowed-out parts or the notched parts, formed in the inversed V-shape, and in the V-shape, respectively.

6. The stationary induction apparatus according to claim 1, wherein a joint between the core-yoke and the core-leg at the center is formed in an inversed Y-shape, in an upper core-yoke, while being formed in a Y-shape in a lower core-yoke, and the concave hollowed-out part or the notched part, formed rectangular in shape, is provided in the joints between the core-yoke and the core-leg at the center, formed in the inversed Y-shape, and in the Y-shape, respectively, whereupon the vibration insulator is disposed in the concave hollowed-out part or the notched part, formed rectangular in shape.

7. The stationary induction apparatus according to claim 1, wherein a joint between the core-yoke and the core-leg at the center is formed in an inversed Y-shape, in an upper core-yoke, while being formed in a Y-shape, in a lower core-yoke, and the concave hollowed-out part or the notched part, formed in the inversed Y-shape, is provided in the joints between the core-yoke and the core-leg at the center in the upper core-yoke, the concave hollowed-out part or the notched part, formed in the Y-shape, is provided in the joints between the core-yoke and the core-leg at the center in the lower core-yoke, whereupon the vibration insulator is disposed in the concave hollowed-out part or the notched part, formed in the inversed Y-shape and the Y-shape.

8. The stationary induction apparatus according to claim 1, wherein a joint between the core-yoke and the core-leg at the center is formed in an inversed V-shape, in an upper core-yoke, while being formed in a V-shape, in a lower core-yoke, and the concave hollowed-out part or the notched part, formed rectangular in shape, is provided in the joints between the core-yoke and the core-leg at the center, formed in the inversed V-shape, and in the V-shape, respectively, whereupon the vibration insulator is disposed in the concave hollowed-out part or the notched part, formed rectangular in shape.

9. The stationary induction apparatus according to claim 8, wherein there are provided a plurality of pieces of the concave hollowed-out parts or the notched parts, each thereof being formed rectangular in shape.

* * * * *